US008296065B2

(12) United States Patent
Haynie et al.

(10) Patent No.: US 8,296,065 B2
(45) Date of Patent: Oct. 23, 2012

(54) SYSTEM AND METHOD FOR VITALLY DETERMINING POSITION AND POSITION UNCERTAINTY OF A RAILROAD VEHICLE EMPLOYING DIVERSE SENSORS INCLUDING A GLOBAL POSITIONING SYSTEM SENSOR

(75) Inventors: Michael B. Haynie, Harmony, PA (US); William R. Laurune, Mars, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 511 days.

(21) Appl. No.: 12/480,354

(22) Filed: Jun. 8, 2009

(65) Prior Publication Data

US 2010/0312461 A1 Dec. 9, 2010

(51) Int. Cl.
*G01C 21/10* (2006.01)

(52) U.S. Cl. ..... 701/505; 701/449; 701/468; 701/469; 701/470; 701/471; 701/472; 701/473; 701/501; 701/502; 701/506; 701/507; 701/508; 701/509; 701/518

(58) Field of Classification Search ..... 701/1, 19, 701/20, 200–221
See application file for complete search history.

(56) References Cited

U.S. PATENT DOCUMENTS 4,619,425 A 10/1986 Nagel
4,713,767 A * 12/1987 Sato et al. ..... 701/220
4,790,191 A 12/1988 Shultz, Jr.
5,129,605 A * 7/1992 Burns et al. ..... 246/5
5,332,180 A * 7/1994 Peterson et al. ..... 246/3
5,394,333 A * 2/1995 Kao ..... 701/217
5,529,267 A * 6/1996 Giras et al. ..... 246/120
5,617,317 A * 4/1997 Ignagni ..... 701/215
5,623,244 A * 4/1997 Cooper ..... 340/425.5
5,740,547 A * 4/1998 Kull et al. ..... 701/19
5,745,868 A * 4/1998 Geier ..... 701/216
5,862,511 A 1/1999 Croyle et al.
5,867,122 A * 2/1999 Zahm et al. ..... 342/357.33
5,893,043 A * 4/1999 Moehlenbrink et al. ..... 701/207
5,902,351 A * 5/1999 Streit et al. ..... 701/220

(Continued)

OTHER PUBLICATIONS

Wikimedia Foundation Inc., "Kalman filter", http://en.wikipedia.org/wiki/Kalman_filter, Jun. 15, 2006, 13 pp.

*Primary Examiner* — Khoi Tran
*Assistant Examiner* — Bhavesh V Amin
(74) *Attorney, Agent, or Firm* — Eckert Seamans Cherin & Mellott, LLC; Kirk D. Houser

(57) ABSTRACT

A system vitally determines a position of a train. The system includes a plurality of diverse sensors, such as tachometers and accelerometers, structured to repetitively sense at least change in position and acceleration of the train, a global positioning system sensor, which is diverse from each of the diverse sensors, structured to repetitively sense position of the train, and a track map including a plurality of track segments which may be occupied by the train. A processor cooperates with the diverse sensors, the global positioning system sensor and the track map. The processor includes a routine structured to provide measurement uncertainty for each of the diverse sensors and the global positioning system sensor. The routine cross-checks measurements for the diverse sensors, and cross-checks the global positioning system sensor against the track map. The routine provides the vitally determined position of the train and the uncertainty of the vitally determined position.

22 Claims, 4 Drawing Sheets

U.S. PATENT DOCUMENTS 5,912,643 A * 6/1999 Chew et al. ..... 342/457
5,928,309 A * 7/1999 Korver et al. ..... 701/214
5,948,043 A 9/1999 Mathis
5,986,547 A * 11/1999 Korver et al. ..... 340/500
6,014,608 A * 1/2000 Seo ..... 701/207
6,081,230 A * 6/2000 Hoshino et al. ..... 342/357.32
6,127,970 A * 10/2000 Lin ..... 342/357.31
6,128,558 A * 10/2000 Kernwein ..... 701/19
6,205,400 B1 * 3/2001 Lin ..... 701/214
6,218,961 B1 * 4/2001 Gross et al. ..... 340/903
6,298,318 B1 * 10/2001 Lin ..... 703/23
6,311,109 B1 * 10/2001 Hawthorne et al. ..... 701/19
6,327,533 B1 12/2001 Chou
6,373,403 B1 * 4/2002 Korver et al. ..... 340/988
6,385,534 B1 5/2002 Yoshimura et al.
6,401,027 B1 6/2002 Xu et al.
6,456,938 B1 9/2002 Barnard
6,496,778 B1 12/2002 Lin
6,516,273 B1 2/2003 Pierowicz et al.
6,641,090 B2 * 11/2003 Meyer ..... 246/122 R
6,728,637 B2 4/2004 Ford et al.
6,735,523 B1 5/2004 Lin et al.
6,789,014 B1 9/2004 Rekow et al.
6,824,110 B2 11/2004 Kane et al.
6,826,478 B2 * 11/2004 Riewe et al. ..... 701/220
6,865,454 B2 * 3/2005 Kane et al. ..... 701/19
6,924,736 B2 8/2005 Oexmann et al.
7,395,140 B2 * 7/2008 Christie et al. ..... 701/19
7,542,831 B2 * 6/2009 Christie et al. ..... 701/19
7,650,207 B2 * 1/2010 Metzger ..... 701/19
7,729,819 B2 * 6/2010 Rajaram ..... 701/19
7,848,881 B2 * 12/2010 Tan et al. ..... 701/207
7,966,126 B2 * 6/2011 Willis et al. ..... 701/220
2002/0062193 A1 5/2002 Lin
2002/0077733 A1 6/2002 Bidaud
2003/0036849 A1 2/2003 Ford et al.
2003/0212488 A1 11/2003 Oexmann et al.
2003/0236598 A1 12/2003 Villarreal Antelo et al.
2004/0015275 A1 1/2004 Herzog et al.
2004/0026574 A1 2/2004 Seifert
2004/0138788 A1 7/2004 Herzog et al.
2004/0140405 A1 * 7/2004 Meyer ..... 246/122 R
2004/0181320 A1 * 9/2004 Kane et al. ..... 701/19
2004/0225432 A1 11/2004 Pilley et al.
2005/0085961 A1 4/2005 Kane et al.
2005/0107954 A1 5/2005 Nahla
2007/0010940 A1 * 1/2007 Tan et al. ..... 701/207
2008/0039991 A1 * 2/2008 May et al. ..... 701/25
2009/0210154 A1 * 8/2009 Willis et al. ..... 701/210

* cited by examiner

SYSTEM AND METHOD FOR VITALLY DETERMINING POSITION AND POSITION UNCERTAINTY OF A RAILROAD VEHICLE EMPLOYING DIVERSE SENSORS INCLUDING A GLOBAL POSITIONING SYSTEM SENSOR

BACKGROUND OF THE INVENTION

1. Field of the Invention

This invention pertains generally to systems for monitoring railroad vehicles and, more particularly, to such systems for determining the position of a train. The invention also pertains to methods for determining the position of a railroad vehicle.

2. Background Information

In the art of railway signaling, traffic flow through signaled territory is typically directed by various signal aspects appearing on wayside indicators or cab signal units located on board railway vehicles. The vehicle operators recognize each such aspect as indicating a particular operating condition allowed at that time. Typical practice is for the aspects to indicate prevailing speed conditions.

For operation of this signaling scheme, a track is typically divided into cascaded sections known as "blocks." These blocks, which may be generally as long as about two to about five miles, are electrically isolated from adjacent blocks by typically utilizing interposing insulated joints. When a block is unoccupied, track circuit apparatus connected at each end are able to transmit signals back and forth through the rails within the block. Such signals may be coded to contain control data enhancing the signaling operation. Track circuits operating in this manner are referred to as "coded track circuits." One such coded track circuit is illustrated in U.S. Pat. No. 4,619,425. When a block is occupied by a railway vehicle, shunt paths are created across the rails by the vehicle wheel and axle sets. While this interrupts the flow of information between respective ends of the block, the presence of the vehicle can be positively detected.

In the case of trains in signaled territory, control commands change the aspects of signal lights, which indicate how trains should move forward (e.g., continue at speed; reduce speed; stop), and the positions of switches (normal or reverse), which determine the specific tracks the trains will run on. Sending the control commands to the field is done by an automated traffic control system, or simply control system. Control systems are employed by railroads to control the movements of trains on their individual properties or track infrastructures. Variously known as Computer-Aided Dispatching (CAD) systems, Operations Control Systems (OCS), Network Management Centers (NMC) and Central Traffic Control (CTC) systems, such systems automate the process of controlling the movements of trains traveling across a track infrastructure, whether it involves traditional fixed block control or moving block control assisted by a positive train control system. The interface between the control system and the field devices is typically through control lines that communicate with electronic controllers at the wayside, which in turn connect directly to the field devices.

In dark (unsignaled) territory, forward movement of trains is specified in terms of mileposts (e.g., a train is given the authority to move from its current location to a particular milepost along its planned route), landmarks or geographic locations. Controlling the movements of trains is effected through voice communication between a human operator monitoring the control system and the locomotive engineer. The operator is responsible for authorizing the engineer to move the train and to manually perform state-changing actions, such as throwing switches, so that the train is able to follow the operator-specified route. Typical railroad voice exchanges are prescribed conversations involving specific sequences of sentences that fit the situation. For example, the engineer will periodically report the train's position by telling the dispatcher "Train BX234 is by Milepost 121.4". The operator will repeat the position report back to the engineer while entering it into the Computer Aided Dispatching system. The engineer will validate the entry by saying "That is correct" or some similar phrase, standard for that railroad. In this way, the operator knows where all trains are and the limits of their movement authorities so that the operator is able to direct their movements in a safe manner.

At least one alternative train positioning system (ERTMS) utilizes a system of short range radio frequency transmitter/receiver pairs. As the train approaches a protected area, such as a grade crossing or switching interchange, the onboard transmitter emits a signal that elicits a response from the wayside installation. The exchange between the system onboard the train and the wayside installation causes the train to update its position (by observed proximity to the transmitter) and be granted movement authority (delivered to the train by a wayside transmitter from a network operations center). The ERTMS system has been observed to require considerable preparation and careful installation.

Other known systems and methods determine train position. For example, U.S. Pat. No. 4,790,191 discloses a dead reckoning and map matching process in combination with Global Positioning System (GPS) sensors. When relative navigation sensors (e.g., vehicle odometer; differential odometer) are providing data within an acceptable error, the system does not use the GPS data to update the vehicle's position. The system does use GPS data to test whether the data from the relative sensors are within the acceptable error. If not, the system resets the vehicle's position to a position calculated based on the GPS data and then the system performs a "dead reckoning" cycle followed by "map matching".

U.S. Pat. No. 5,862,511 discloses a vehicle navigation system and method that uses information from a GPS to obtain velocity vectors, which include speed and heading components, for "dead reckoning" the vehicle position from a previous position. If information from the GPS is not available, then the system uses information from an orthogonal axes accelerometer, such as two or three orthogonally positioned accelerometers, to propagate vehicle position. The system retains the accuracy of the accelerometers by repeatedly calibrating them with the velocity data obtained from the GPS information.

U.S. Pat. No. 5,948,043 discloses a navigation system for tracking an object, such as an automobile as it moves over streets, using an electronic map and a GPS receiver, and claims that the system functions without using data from navigation sensors other than one or more GPS sensors. The GPS receiver accepts data from a number of satellites and determines a GPS derived position and velocity. Based on the previous position of the object, the GPS derived position, the velocity, the dilution of precision (DOP), and the continuity of satellites for which data is received, the system determines whether the GPS data is reliable. When determining whether the GPS data is reliable, the first step is to compare the GPS derived position to the previous position (e.g., from map matching). If the GPS data is reliable, then the previous position of the object is updated to the GPS derived position. The updated position is then matched to a map of roads.

U.S. Patent Application Publication No. 2003/0236598 discloses an integrated railroad traffic control system that links each locomotive to a control center for communicating data and control signals. Using on-board computers, GPS and two-way communication hardware, rolling stock continuously communicate position, vital sign data, and other information for recording in a data base and for integration in a comprehensive computerized control system. The position of each train is determined in real time by the use of a conventional positioning system, such as GPS, and is communicated to the dispatcher, so that the progress of each train can be followed and compared to the expected schedule expressed in the relevant train graph and panel. A separate channel is used to receive, record and transmit signals from mile-mark tag readers placed along the tracks in order to periodically confirm the exact position of the train. These signals are emitted by sensors that detect and identify specific tags placed wayside while the train is passing by. Since they are based on precisely fixed markers, the train positions so recorded are used to double-check and, if necessary, correct corresponding GPS positioning data. An input/output channel is provided to receive, record and transmit data from vital sign sensors on the train, such as pressure and/or temperatures of hydraulic systems and other operating parameters deemed important for safe and efficient maintenance and operation.

U.S. Pat. No. 6,496,778 discloses three conventional approaches for integrating GPS and an inertial navigation system (INS). The first approach is to reset directly the INS with the GPS-derived position and velocity. The second approach is cascaded integration where the GPS-derived position and velocity are used as the measurements in an integration Kalman filter. The third approach is to use an extended Kalman filter which processes the GPS raw pseudorange and delta range measurements to provide optimal error estimates of navigation parameters, such as the inertial navigation system, inertial sensor errors, and the global positioning system receiver clock offset.

A Kalman filter is an efficient recursive filter that estimates the state of a dynamic system from a series of incomplete and noisy measurements. For example, in a radar application, where one is interested in tracking a target, information about the location, speed and acceleration of the target is measured with a great deal of corruption by noise at any instant of time. The Kalman filter exploits the dynamics of the target, which govern its time evolution, to remove the effects of the noise and get a good estimate of the location of the target at the present time (filtering), at a future time (prediction), or at a time in the past (interpolation or smoothing). The Kalman filter is a pure time domain filter, in which only the estimated state from the previous time step and the current measurement are needed to compute the estimate for the current state. In contrast to batch estimation techniques, no history of observations and/or estimates are required. The state of the filter is represented by two variables: (1) the estimate of the state at time k; and (2) the error covariance matrix (a measure of the estimated accuracy of the state estimate). The Kalman filter has two distinct phases: Predict and Update. The Predict phase uses the estimate from the previous time step to produce an estimate of the current state. In the Update phase, measurement information from the current time step is used to refine this prediction to arrive at a new, (hopefully) more accurate estimate.

The Kalman filter technique depends critically on a well tuned covariance matrix, which, in turn, depends critically on the dynamics of the modeled system. Train dynamics, while well understood and predicable in controlled circumstances are notoriously variable in actual operation, due largely to the variability of the loads applied. Thus, claims of vitality for position systems that rely on the Kalman filtering technique are believed to be difficult to demonstrate.

U.S. Pat. No. 6,826,478 discloses that various auxiliary input data are provided to a Kalman filter which processes the auxiliary input data to determine and provide state corrections to an inertial navigation and sensor compensation unit. These state corrections from the Kalman filter are used by the inertial navigation and sensor compensation unit to enhance the accuracy of position, velocity, attitude and accuracy outputs, thereby enhancing the accuracy of the aided inertial navigation system (AINS). The auxiliary input data includes GPS data, speed data, map information, wheel angle data, and other discrete data, such as from transponders or rail detectors if the AINS is applied to a railcar or other similar applications. The AINS calculates the distance to the next map point. This information may be desirable for various applications in modern railcars, such as positive train control, in which various functions and operations of the train are automated. Such calculated distance is based on the best estimate of position, in which case there may be sudden changes if the quality of the input data improves suddenly, again for example, if GPS data is reacquired.

U.S. Pat. No. 6,826,478 also discloses that the calculated distance along the path is always smoothly changing. An illustration depicts a confidence value as a confidence circle. A mobile object is at a determined position along the path or track. The confidence circle indicates that the actual position of the mobile object is within the confidence circle from the determined position. As the confidence circle decreases in size, the distance that the determined position can deviate from the actual position of the mobile object decreases, and vice versa.

U.S. Patent Application Publication No. 2002/0062193 discloses a geospatial database access and query method, such as a map and Inertial Measurement Unit/Global Positioning System (IMU/GPS) navigation process. This supports real time mapping by using IMU/GPS integrated system as the positioning sensor. A point query is aimed at finding the node (connected or entity) in the vicinity of the query point. The vicinity area is defined as a circle on the screen with a radius and centered at the query point. The location data from the map matching process module is fed to a Kalman filter that blends the measurements from an Inertial Measurement Unit and a GPS receiver to further correct navigation errors.

U.S. Pat. No. 6,641,090 discloses a train location system and method of determining track occupancy. The system utilizes inertial measurement inputs, including orthogonal acceleration inputs and turn rate information, in combination with wheel-mounted tachometer information and GPS/DGPS position fixes to provide processed outputs indicative of track occupancy, position, direction of travel and velocity. Various navigation solutions are combined together to provide the desired information outputs using an optimal estimator designed specifically for rail applications and subjected to motion constraints reflecting the physical motion limitations of a locomotive. A rate gyro, a first accelerometer board and a second accelerometer board provide, respectively, rate of turn and three-axis acceleration information to processing electronics. Information vectors from sources having different error characteristics are geo-reconciled to reduce the adverse effect of short- and long-term errors. In the context of the velocity vector, for example, an inertially derived velocity vector is geo-reconciled with a geo-computed velocity vector obtained, for example, from the calibrated wheel tachometer and the train forward axis or track centerline axis. In general, the inertially obtained and tachometer derived velocity vectors will be different based upon the cumulative errors in each system. An optimal estimator functions to blend two such values to obtain the geo-reconciled velocity vector. With each successive computation sequence, the optimal estimator functions to estimate the error mechanisms and effect corrections to successively propagate position and the associated uncertainty along the track. A main process module fuses three inertial navigation solutions together, aided by exogenous GPS/DGPS receiver data and tachometer data in a position computation (Kalman) optimal estimator. The three navigation solutions include: (a) conventional strapdown navigation solution using a single Z-axis gyro and nulled x- and y-channels; (b) a projection of the inertial data along the occupied track profile reconstructed from parameters on the fly, and then being integrated appropriately (e.g., for position; speed); and (c) projection of the inertial data along the locomotive (cab) fixed reference axes and then being appropriately integrated for location. The three navigation solutions are optimally blended with the external GPS/DGPS receiver and the tachometer data, and the solution is subjected to motion constraints reflecting the physical limitations of how a locomotive can move.

U.S. Patent Application Publication No. 2005/0107954 discloses a collision warning and avoidance system which includes an integrated on-board Train Navigation Unit and a GPS Interface Subsystem to locate a train. The system includes a GPS location signal, fixed transponder stations, and a calibrated, rectified transponder identification subsystem for scanning the track based transponders for override of train controls in the event of a collision risk. A database includes all transponders, their location and the track ID on which they are located. A logic associative memory is in communication with a control signal generator, which is capable of emitting a signal responsive to input data to override train controls to effect braking in the event of a collision risk.

There is room for improvement in systems and methods for determining the position of a railroad vehicle with respect to both accuracy and vitality.

SUMMARY OF THE INVENTION

This need and others are met by embodiments of the invention, which provide an apparatus and method for vitally determining railroad vehicle position and uncertainty employing, for example, differential GPS position reports, which are cross-checked against a track map, and also employing plural diverse sensors, such as, for example, tachometers and accelerometers. The resulting railroad vehicle position information is sufficiently reliable for use in vital applications (e.g., without limitation, vital Automatic Train Protection or Automatic Train Operation (ATP/ATO) functions, such as vital braking applications).

The vitally-determined railroad vehicle position information can include, for example and without limitation: (1) (T,d): a best estimate of position (in terms of the track T and distance d along the track); (2) $\sigma$: a standard deviation from that position; (3) $4\sigma$: a position uncertainty that acts as a safety envelope around the railroad vehicle for use by ATP/ATO functions; and (4) either a reliable position—i.e., its value has a high probability (to be specified) of falling within an acceptable range—or an indication that such a reliable position is unknown, in order for the ATP/ATO functions to move the railroad vehicle safely.

In accordance with one aspect of the invention, a system for vitally determining position of a railroad vehicle comprises: a plurality of diverse sensors structured to repetitively sense at least change in position and acceleration of the railroad vehicle; a global positioning system sensor, which is diverse from each of the diverse sensors, structured to repetitively sense position of the railroad vehicle; a track map including a plurality of track segments which may be occupied by the railroad vehicle; and a processor cooperating with the diverse sensors, the global positioning system sensor and the track map, the processor comprising a routine structured to: (1) provide measurement uncertainty for each of the diverse sensors and the global positioning system sensor, (2) cross-check measurements for each of the diverse sensors, and (3) cross-check the global positioning system sensor against the track map, and (4) provide the vitally determined position of the railroad vehicle and the uncertainty of the vitally determined position.

Preferably, the global positioning system sensor is the only direct measurement of location in the system.

As another aspect of the invention, a method of vitally determining a position of a railroad vehicle comprises: employing a plurality of diverse sensors to repetitively sense at least change in position and acceleration of the railroad vehicle; employing a global positioning system sensor, which is diverse from each of the diverse sensors, to repetitively sense position of the railroad vehicle; employing a track map including a plurality of track segments which may be occupied by the railroad vehicle; providing measurement uncertainty for each of the diverse sensors and the global positioning system sensor; cross-checking measurements for each of the diverse sensors; cross-checking the global positioning system sensor against the track map; and providing the vitally determined position of the railroad vehicle and the uncertainty of the vitally determined position from the sensed at least change in position and acceleration of the railroad vehicle from the diverse sensors and from the sensed position of the railroad vehicle from the global positioning system sensor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
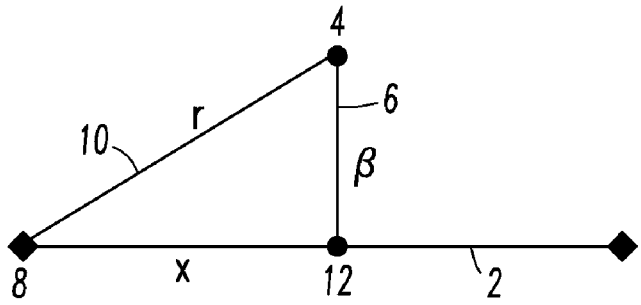
FIG. 1 is a representation showing the difference between a GPS reading and the actual position of a railroad vehicle on a railway.

As employed herein, the terms "railroad" or "railroad service" shall mean freight trains or freight rail service, passenger trains or passenger rail service, transit rail service, and commuter railroad traffic, commuter trains or commuter rail service.

As employed herein, the terms "traffic" or "railroad traffic" shall mean railroad traffic, which consists primarily of freight trains and passenger trains, and commuter railroad traffic, which consists primarily of passenger trains, although it can include freight trains.

As employed herein, the term "railroad vehicle" shall mean any rail vehicle (e.g., without limitation, trains; vehicles which move along a fixed guideway where lateral movement is restricted by the guideway) employed in connection with railroad service or railroad traffic.

The following symbols and/or definitions are employed herein:

T: Track segment. A track segment is assumed to be linear and less than about 100 feet in length. Certain track segments may be connected by switches, which are also represented as track segments. The about 100 foot length is determined by the requirements of Automatic Train Protection or Automatic Train Operation (ATP/ATO) functions, which length is sufficiently short such that curvature does not introduce significant error. Track segments also include segments of guideways.

d: Distance along a track segment from the reference end thereof.

σ: Standard deviation of a measurement. The units of σ match the units of the measured quantity. This standard deviation is distinct from both resolution and accuracy and may also be referred to herein as certainty or uncertainty, depending upon the context.

Q: Data quality. Data quality indicates whether a signal is usable (e.g., Q=1), independent of σ. For example, a single GPS reading is considered to have bad quality (e.g., Q=0; the signal is not usable) if too many previous GPS readings are unusable due to excessive orthogonal offset. Usability is defined for each type of measurement.

A: Acceleration.

V: Velocity.

SW: Switch position. The switch position is presumed to be vitally determined by another vital mechanism (e.g., without limitation, through vital transmissions to a vehicle; through vital communications from a switch controller; through voice communication of a person operating the switch with a central network operation center). Note that communication between humans is non-vital, although it is viewed as an acceptable level of safety in the absence of vital mechanisms for determining, for example, track occupancy or switch position. That is, it is accepted as safe for dark territory control or when such control is in force.

Map: Vitally accurate track map data containing track segments and switches (track map vitality depends on doing a survey, validating it, and then validating the encoding).

(Lat,Lon): A position on the earth (latitude and longitude), commonly obtained from a Global Positioning System (GPS) device, possibly augmented with a differential position signal (DPGS).

F(x) is a normal distribution function defined as:

$$F(x) = \int_{-\infty}^{x} \frac{1}{\sqrt{2\pi}\,\sigma} e^{-(x-\mu)^2/2\sigma^2}\,dx$$

wherein:

μ is the mean of the distribution; and

σ is the standard deviation.

As employed herein, the term "vital" means that the acceptable probability of a hazardous event resulting from an abnormal outcome associated with an activity or device is less than about $10^{-9}$/hour (this is a commonly accepted hazardous event rate for vitality). That is, the Mean Time Between Hazardous Events (MTBHE) is greater than $10^9$ hours (approximately 114,000 years). For example, for a train location system to be considered vital, the uncertainty of the position is of such a value that the probability of a hazardous event resulting from a failure of the system due to that uncertainty is less than about $10^{-9}$/hour. Also, it is assumed that static data used by such a vital system, including, for example, track map data, has been validated by a suitably rigorous process under the supervision of suitably responsible parties.

The invention is described in association with a system for vitally determining the position of a railroad vehicle, although the invention is applicable to a wide range of systems and methods for vitally determining the position of a railroad vehicle, or any system in which a vehicle moves along a fixed guideway where lateral movement is restricted by the guideway.

Figure 2:
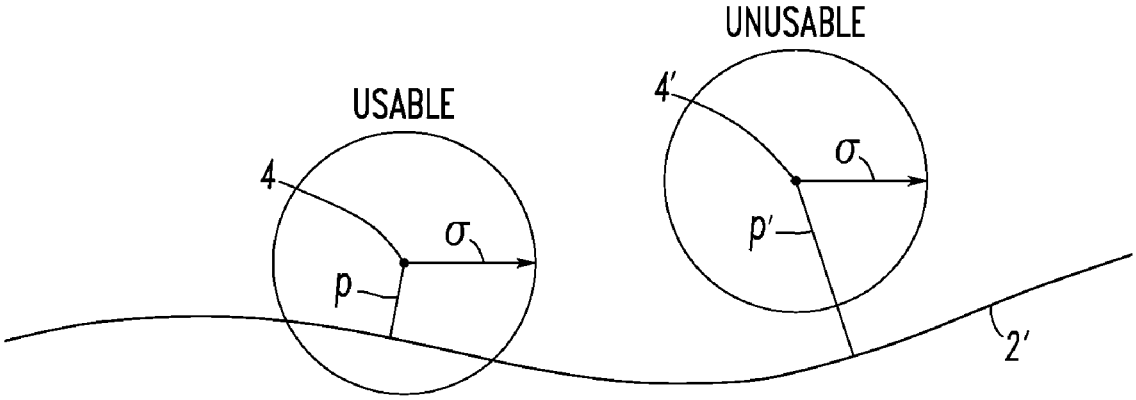
FIG. 2 is a diagram showing usable and unusable GPS readings.

Referring to FIGS. 1 and 2, GPS coordinates are interpreted in the context of a track map. FIG. 1 depicts a GPS reading 4 offset β units from the centerline of a railway 2 and offset x units along the railway 2 from the actual location of a railroad vehicle 8. Because the line 6 is perpendicular to the railway 2, the distance 10 between the GPS reading 4 and the railroad vehicle's actual location 8, which is the radial GPS error represented by r, is equal to $\sqrt{\beta^2+x^2}$. Given a standard normal distribution (μ=0, σ=1) for GPS readings, with the mean centered on the location 8 of the railroad vehicle, which is also the location of the GPS unit, the probability density function for this distance is:

$$n(r) = \frac{e^{-r^2}}{\sqrt{2\pi}} = n(x, \beta) = \frac{e^{-(x^2+\beta^2)}}{\sqrt{2\pi}}$$

Integrating over the probability density gives the probability that the railroad vehicle lies within a distance, r, of the GPS reading 4, which is equal to the probability of the railroad vehicle lying within a distance $x=\sqrt{r^2-\beta^2}$ along the railway 2 from location 12, which is the point where the line 6 perpendicular to the railway 2 intersects it.

FIG. 2 shows usable 4 and unusable 4' GPS readings in which the offset p of the usable GPS reading 4 is less than σ (which is taken here to be the tolerable offset threshold for purposes of illustration), and the offset p' of the unusable GPS reading 4' is greater than σ.

Any GPS reading taken aboard a railroad vehicle (e.g., a locomotive; a maglev vehicle; a guideway vehicle) must be a point near a track segment 2' represented in a track map (not shown) if the locomotive is on the railway (as opposed to being on an unmapped industrial siding). The requirement for a GPS reading to be near a track segment stems from the idea that it is statistically rare for a reading to be far from a track segment, implying that the reading is questionable (i.e., is likely to be unusable). Since radial GPS errors are distributed randomly in all directions around the railroad vehicle, virtually all readings will be some distance x from the intersection 12 of the railway 2 and the line 6 perpendicular to the railway 2 of FIG. 1. Consequently, if a reading lies just beyond, say, σ as the tolerable offset, it will most likely be farther from the railroad vehicle location 8 and, therefore, even rarer, implying that it should be discarded (ironically, the farther a GPS reading is from the railway 2, the more likely it is that the railroad vehicle will be near the intersection 12 of the railway 2 and the line 6 perpendicular to the railway, as depicted in FIG. 1).

If a GPS position reading lies directly on the centerline of the railway 2 of FIG. 1, then the probability that the actual position of the railroad vehicle is offset along the railway from the GPS reading 4 is given by the standard normal distribution:

$$n(x) = \frac{e^{-x^2}}{\sqrt{2\pi}}$$

This distribution, when integrated, yields a total probability of 1. Now if the position reading is offset (line 6 of FIG. 1) (β) from the centerline of the railway 2, and is offset by some distance, x, along the railway 2, then a position probability distribution, p(x, β)=n(r(x, β)), is the normal distribution adjusted to account for the hypotenuse offset (r of FIG. 1). So, for example, the normal distribution can be adjusted to reflect reading offsets of 1σ(p(x, 1)) or 2σ(p(x, 2)). The integrated distribution, with 1σ offset, has a total available probability of about 0.61, as indicated by Table 1, below, while the integrated distribution, with 2σ offset, has a total available probability of about 0.135, as also indicated by Table 1. The available probability values show a reduction in the utility of a GPS reading as the offset increases.

Off-track GPS readings are mapped to on-track positions according to the following three rules. Referring to FIG. 2, first, select the track segment 2' whose endpoints are closest to the GPS coordinate 4 (or 4'). That track segment 2' will normally be the most recent track segment or an adjacent track segment, which is possibly dependent on switch position. Second, project the GPS coordinate 4 (or 4') onto the track segment 2' along the line 6 (shown in FIG. 1 with railway 2) (shown as offsets p or p' in FIG. 2) perpendicular to the track segment. Third, if the perpendicular distance is greater than an agreed upon tolerable offset (for purposes of illustration, FIG. 2 uses σ of the GPS unit), discard the reading. If kσ, where k is a constant, is the tolerable offset, then, for example, 1σ(k=1) would cause the system to reject just under half the GPS reports, while 3σ(k=3) would cause the system to retain too many. It seems likely that k=1.5 or 2 is the best choice, but it could be any value satisfying 1<k<3.

TABLE 1

| | | |
|---|---|---|
| a | y = n(x) | The standard normal distribution |
| b | y = p(x, 1) | The standard normal distribution, adjusted to reflect a reading offset of 1σ |
| c | y = p(x, 2) | The standard normal distribution, adjusted to reflect a reading offset of 2σ |
| a, integrated | $y = \int_{-\infty}^{x} n(x)dx$ | The standard normal distribution, integrated, with a total probability of 1 |
| b, integrated | $y = \int_{-\infty}^{x} p(x, 1)dx$ | The integrated distribution with 1σ offset, with a total available probability of 0.61 |
| c, integrated | $y = \int_{-\infty}^{x} p(x, 2)dx$ | The integrated distribution with 2σ offset, with a total available probability of 0.135 |

As employed herein, measurement uncertainty is represented as a normal distribution, with a known standard deviation (this value is published). When the measurements are diverse indicators (i.e., obtained from different kinds of measuring devices) of the same process, the statistics may be combined. Equation 1 provides a slightly pessimistic standard deviation estimate for the combination of normally distributed samples (i.e., for each device).

$$\{\mu, \sigma\} = \left\{ \frac{\sum \mu_i}{n}, \sqrt{\frac{\sum \sigma_i^2}{n}} \right\} \quad \text{(Eq. 1)}$$

wherein:

μ is the average measured value (or mean value);

σ is the standard deviation;

$\mu_i$ is the ith measured sample used to determine the average measured value μ;

n is the number of samples; and $\sigma_i$ is the deviation of the ith measured sample from the average measured value μ.

As employed herein, the standard deviation, $\sigma_v$, of a variable (e.g., velocity, v, of Equation 2A), derived from the integration (or differentiation) of a variable (e.g., the integration of acceleration, a, as shown in Equation 2A), is the numerical integration (or differentiation) of the standard deviation, $\sigma_a$ (e.g., as shown in Equation 2B), of the integrated (or differentiated) variable.

$$v = \int a dt \quad \text{(Eq. 2A)}$$

$$\sigma_v = \int \sigma_a dt \quad \text{(Eq. 2B)}$$

Table 2 contains the probabilities that a randomly selected sample from a normally distributed set of measurements will be more than xσ away from the mean, wherein x is varied from 1 to 7.

TABLE 2

| x | 1 − F(x) | P(3)/hr |
|---|---|---|
| 1 | 1.5866E−01 | 1.44E+01 |
| 2 | 2.2750E−02 | 4.24E−02 |
| 3 | 1.3499E−03 | 8.86E−06 |
| 4 | 3.1671E−05 | 1.14E−10 |
| 5 | 2.8665E−07 | 8.48E−17 |
| 6 | 9.8659E−10 | 3.46E−24 |
| 7 | 1.2798E−12 | 7.55E−33 |

Figure 3:
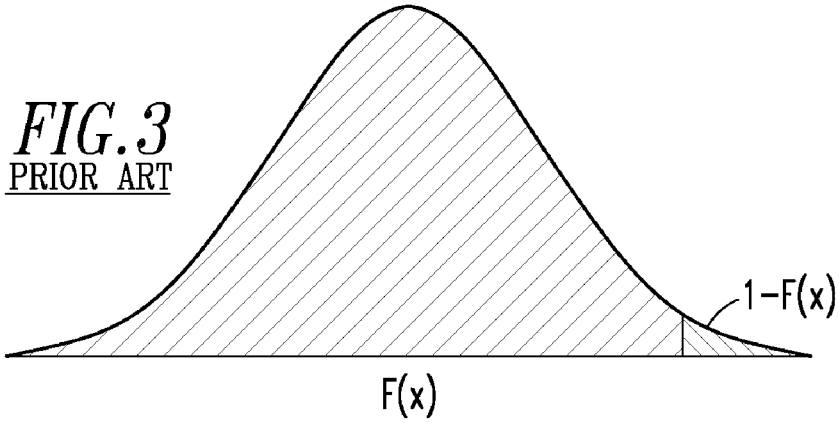
FIG. 3 PRIOR ART
FIG. 3 is a plot of an ordinary normal distribution (F(x)) including a one-tailed test (1−F(x)).

The first column of Table 2 is the normalized statistical distance from the mean. The second column is the ordinary normal distribution for a one-tailed test, which is indicated by the rightmost portion (1−F(x)) of FIG. 3. Here, F(x) is the conventional cumulative distribution function of a normally distributed variable. The values are for a one-tailed test (in contrast to a two-tailed test), because the concern here is with the train being ahead of its indicated position. The third column contains the probability of three successive readings with that x or larger occurring during an hour interval, assuming one reading per second.

Thus, for example, if a differential GPS (DGPS) position report has a typical standard deviation of 3 feet, then the probability that the actual position is more than 9 feet (3σ) away is about 0.0013. The probability that the actual position is more than 18 feet (6σ) away is about $9.8\times10^{-10}$. The probability that three successive measurements are further than 6σ away is the product of the probabilities of the individual readings $(9.8\times10^{-10})^3$, or about $9.41\times10^{-28}$. If there are 3600 such readings an hour, then the probability is about $3.4\times10^{-24}$/hour of a sequence of three GPS readings being in error by more than 6σ. That is, there are approximately 3600 possible sequences of three successive readings further away than 6σ that could occur within an hour (assuming one reading per second), which is multiplied by the probability of three such successive readings.

Figure 4:
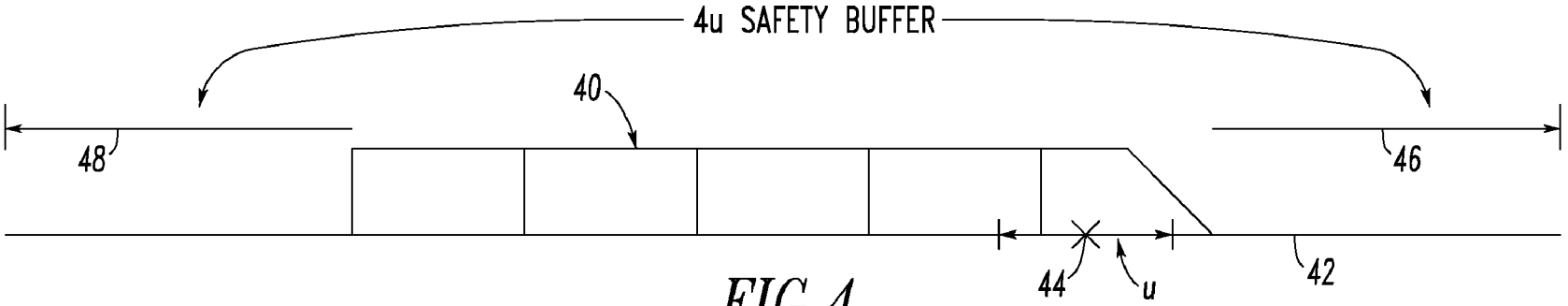
FIG. 4 is a diagram showing position uncertainty in the location of a train locomotive on a section of a railway in which the train is accommodated by front and rear safety buffers.

Position uncertainty in the location of the locomotive of a train is accommodated by a buffer represented at the front and rear of the train. As shown in FIG. 4, the train 40 is traveling on the track 42 of a railway. The GPS report places the train at the "x" position 44 with some uncertainty, labeled "u," which will be constructed from various measurements. Here "u" is equal to "σ", which is the standard deviation of the constructed uncertainty of position. For safety reasons, the train 40 is considered to extend a distance **4*u* 46 in front of the reported position 44. Similarly, the end of the train 40 is considered to extend a distance 4*u* 48 behind the train. Here, 4*u*** reflects the aggregate uncertainty (i.e., uncertainty due to all instruments) of the train's position, and is necessary to ensure that the system is vital according to the required MTBHE for a system to be vital.

As employed herein, a navigation state change model (NSCM) projects the change of state between a previous reading and the next reading of an instrument (e.g., a tachometer; GPS unit). To do this, the model maintains state information at time t−δ (e.g., position and velocity) and applies physical laws, and relationships derived from them, to generate the expected state at time t from it. The size of δ (or Δt) is chosen to be suitably small such that changes in acceleration can be safely ignored. For example, ATP/ATO functions commonly read an accelerometer and/or related instruments about four times per second. The typical maximum acceleration value for a locomotive in normal operation is limited by wheel grip characteristics, and is less than about 2 ft/sec$^2$.

The NSCM uses position, $d_t$, velocity, $V_t$, and acceleration, $A_t$, the values of which, at time t, are respectively shown by Equations 3, 4 and 5, and are collectively shown by the matrix transformation of Equation 6.

$$d_t = A_{t-\delta}(\delta)^2/2 + V_{t-\delta}(\delta) + d_{t-\delta} \quad \text{(Eq. 3)}$$

$$V_t = A_{t-\delta}(\delta) + V_{t-\delta} \quad \text{(Eq. 4)}$$

$$A_t = A_{t-\delta} \quad \text{(Eq. 5)}$$

$$\begin{bmatrix} d \\ V \\ A \end{bmatrix}_t = \begin{bmatrix} 1 & \delta & \delta^2/2 \\ 0 & 1 & \delta \\ 0 & 0 & 1 \end{bmatrix} \begin{bmatrix} d \\ V \\ A \end{bmatrix}_{t-\delta} \quad \text{(Eq. 6)}$$

Figure 5:
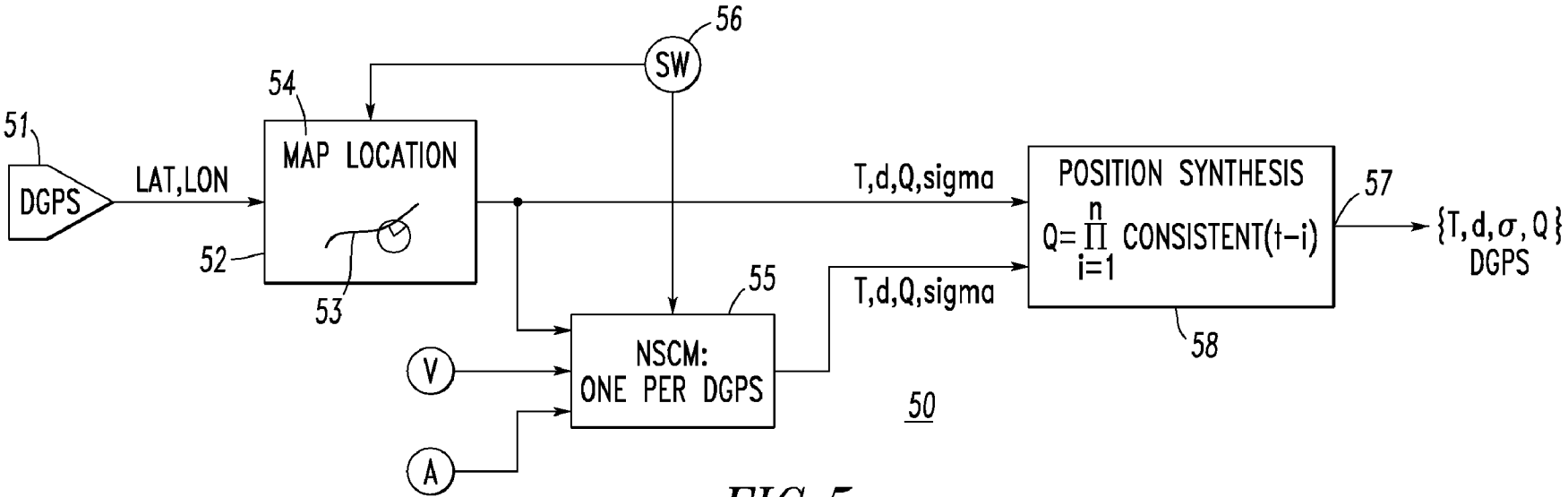
FIG. 5 is a block diagram of a DGPS error propagation routine in accordance with an embodiment of the invention.

The method and system 90 described below in connection with FIGS. 5-9 use suitable cross-checks between various example instruments (e.g., without limitation, 100,102,104, 106,108 of FIG. 9). The instruments are chosen to have diverse failure and error modes. For example, conventional vital tachometer systems make use of two independent tachometers (commonly a reluctance sensor that senses the passing of the teeth on a gear mounted to the axle). To achieve vitality, the tachometers are mounted to different axles so that they may register wheel rotation independently under wheel slip and slide conditions, as discussed below. The tachometer signals are then vitally compared for consistency. The disclosed routines 50,60,70,80 permit the outputs of multiple instruments to be checked for consistency as a group, both: (1) over time; and (2) against the properties of a track map 54 (FIGS. 5 and 9). Inconsistent measurements (those for which there is a significant difference between their values and those of the NSCM 55,68,76) are discarded and known measurement uncertainties are tracked over time.

As will be described, every key conclusion about position, velocity, acceleration and the associated measurement uncertainties thereof is cross-checked against independent measurements from other instruments or calculations for consistency. These cross-checks permit the system 90 (FIG. 9) to detect and discard bad measurements. This mechanism is robust against all measurement error sources that are not common mode errors (e.g., an incorrect track map with a consistent offset parallel to the track would present a common mode error).

Non-limiting examples of the disclosed instruments include a DGPS unit 100 (FIG. 9) providing DGPS position reports 51, two tachometers 102,104, an accelerometer 106, and (optionally) Doppler radar 108 (this is the speed derived from the GPS signal using the Doppler effect, not a separate Doppler radar instrument; the GPS speed is part of the GPS position report, along with position, time, and the DOP values) providing GPS speed reports. It will be appreciated that this mechanism can be modified or extended to employ additional types of sensors for position (e.g., without limitation, wayside fixed beacons), velocity (e.g., without limitation, Doppler radar), and acceleration (e.g., without limitation, a fiber ring gyroscope). Also, multiple sensors of the same type will mitigate against single failures of sensors of that type.

FIG. 5 shows a DGPS error propagation routine 50. Under normal circumstances, the DGPS unit 100 (FIG. 9) produces a DGPS position (Lat, Lon) 51 update about once per second. Nevertheless, DGPS update intervals of as long as a couple minutes and intermittent outages for extended periods are tolerable because of the presence of other measuring instruments.

EXAMPLE 1

DGPS σ (commonly known as the User Equivalent Range Error (UERE)) is determined in part from Differential Lock and Horizontal Dilution of Precision (HDOP) values reported by the DGPS unit 100 and is presumed to be on the order of about 1.6 meters (5 feet). HDOP depends on the relative geometric positioning of the satellites in view (higher values of HDOP indicate relative positions that give less accurate readings). For GPS without differential correction, GPS σ is presumed to be on the order of about 5.3 meters (18 feet), such that 6σ under GPS, without differential correction, is still only about 32 meters (108 feet), which is sufficiently small for railway applications. DGPS σ is smaller because the locations of ground-based reference stations, which are known, are used to correct for atmospheric distortion, ephemeris error, and satellite/receiver clock error. The actual UERE is tracked by the GPS Support Center of the Air Force, currently known as GPSOC. As new satellites are launched, the UERE is expected to decrease, thereby making the above uncertainty values conservative. For example, as of January 2006, GPS UERE is about 1.5 meters as opposed to about 5.3 meters.

At Map Location function 52 of FIG. 5, the DGPS position reading (Lat, Lon) 51 is projected onto a track segment 53 of a track map 54 using the closest approach (perpendicular) method of FIGS. 1 and 2. That position is rejected if the perpendicular distance, p, is greater than kσ, where 1<k<3 (or a suitable UERE value). Otherwise, if the position is usable, then it is output as a (T,d) pair along with position quality, Q (e.g., here, Q=1), and sigma (e.g., DGPS σ or a suitable UERE value). At 55, the NSCM (e.g., Equations 3-5 and/or 6) takes the synthesized velocity, V, and synthesized acceleration, A, (both will be discussed below in connection with function 76 of FIG. 7), along with the previous DGPS position report (T,d) as input. The previous DGPS position report is preferred over the synthetic position (T,d) of output 84 of FIG. 8 because it is a direct measurement. The current DGPS position report is retained for use during the next sample cycle. The DGPS unit 100 (FIG. 9) is separately checked (e.g., as is discussed below in connection with Example 3) for believability. The position from the NSCM 55 is also output as a (T,d) pair along with position quality, Q (e.g., Q=0 for a previous unknown position; Q=1 for a previous known position), and DGPS σ. At 56, the conventional SW function determines on which track segment the train is positioned. Based upon this, the (T,d) pair is suitably constructed by the NSCM 55.

Next, at the Position Synthesis function 58, each usable DGPS reading is compared to the expected change of state as determined by the NSCM 55. The position quality output, Q, records whether the DGPS reading is consistent with the expected position for the last n (e.g., n=3, k=2; any suitable pair of integers) readings. These two positions (from DGPS, at the Map Location function 52, and the NSCM 55), which are constructed from diverse measurements, are considered to be k-consistent if they differ by no more than k standard deviations as represented by Equations 7 and 8. The DGPS quality is considered good if the last n readings are all k-consistent.

$$|d_G - d_N| < k\sigma_G \quad \text{(Eq. 7)}$$

$$|d_G - d_N| < k\sigma_N \quad \text{(Eq. 8)}$$

wherein:

$d_G$ is DGPS position from function 51;

$d_N$ is NSCM position from function 55;

$\sigma_G$ is the DGPS standard deviation from function 52; and $\sigma_N$ is the NSCM standard deviation from function 55.

The output 57 of the Position Synthesis function 58 is the DGPS position (T,d) pair along with position quality, Q, as determined by the function 58 when both of the tests of Equations 7 and 8 are true, along with the DGPS σ. In other words, the track segment, offset and uncertainty (T,d,σ) produced by the Position Synthesis function 58 are the track segment, offset and uncertainty produced by the Map Location function 52.

EXAMPLE 2

The DGPS error propagation routine 50 may employ, for example, GPS reported Differential Lock and HDOP to calculate UERE. The UERE calculation is based on the observation that GPS without differential lock has a normal standard deviation of about 5.3 meters. Adding a differential GPS base unit signal will reduce the ULERE value to about 1.6 meters. Additionally, the grouping of the GPS satellites (not shown) used in the measurement has an effect, which is measured by the HDOP. For example, tightly clustered satellites lead to a relatively large HDOP, while more widely scattered satellites lead to a relatively lower HDOP.

HDOP is defined such that $UERE = HDOP * \sqrt{URE^2 + UEE^2}$, wherein UEE is User Equipment Errors (e.g., receiver noise; antenna orientation; EMI/RFI), which can be reduced to an insignificant value with appropriate equipment design, and URE is the User Range Error, which is due to atmospheric effects (e.g., propagation through the ionosphere), orbital calculation errors, satellite clock bias, multipath and selective availability). Since DGPS position reports are well known to be normally distributed, and because all actual locomotive locations are on a track segment, the orthogonal offset from the track segment is related to the radial DGPS error (see FIG. 1).

To determine whether any particular value of the DGPS standard deviation, σ, is a good fit for the observed data, the system 90 collects the proportion, θ, of orthogonal offsets, $x_i$, that are below the threshold, σ, of the last N readings of the GPS position, where N>44, and $\theta = (\Sigma_{i=1}^{N}(x_i < \sigma))/N$ (the sum over $x_i < \sigma$ in the equation for θ is the number of readings below the threshold). Given that DGPS readings are normally distributed (Equation 9, below) and knowing the DGPS standard deviation, σ, Equation 10 can be used to determine whether the difference between the proportion of readings below the threshold, θ, and the expected proportion of readings below the threshold, $\theta_0$, is statistically significant (i.e., whether the difference is too remote to have occurred by chance). Equation 10 is the basis for what is known as the z-test, which is a statistical test for determining if the difference between the mean of a data sample and the population mean (which is known) is statistically significant. The denominator of Equation 10 is a normal distribution standard deviation for proportions.

$$F(x) = \int_{-\infty}^{x} \frac{1}{(\sqrt{2\pi})\sigma} e^{-(x-\bar{x})^2/2\sigma^2}\, dx \quad \text{(Eq. 9)}$$

$$z = \frac{\theta - \theta_0}{\sqrt{\frac{\theta_0(1-\theta_0)}{N}}} \quad \text{(Eq. 10)}$$

wherein:

$\theta_0$ is the expected proportion of the samples below the selected threshold, σ;

θ is the observed proportion of the samples below the threshold; and

N is the number of samples.

A suitable procedure to calculate θ is as follows: collect N samples; for each sample, calculate the orthogonal offset, x; count the samples where x>σ into C; and then θ=C/N.

By selecting σ as the offset threshold, approximately 68.29% of the radial errors are expected below σ, with the remainder of the radial errors being above σ. The choice of the number of readings, N, is driven by a trade-off between the sample count (i.e., more position measurements will increase the reliability of the sample) and the time needed to sample. In normal operation, 45 samples (i.e., N>44) will be collected over the last 45 seconds. Employing 120 samples would take at least 2 minutes, leaving a longer window in which the conditions may change (the sources of URE are continually changing). A significance level of 5% is assumed here (5% is a typical threshold value for statistical significance), which means that the probability of the difference between a proportion, θ, obtained from N readings and the expected proportion, $\theta_0$ (in this case, 68.29%) should be greater than 5% in order to be confident that the N readings are from a normal distribution with standard deviation, σ (i.e., that the difference can be attributed to chance).

If, for instance, the proportion of readings below the offset threshold is 0.55 and the number of samples is 45, then according to Equation 10, z would equal −1.91, which is the number of standard deviations difference between the observed proportion and the expected proportion. For a one-tailed test (i.e., only proportions below the expected value are important), assuming a normal distribution (Equation 9), −1.91 standard deviations corresponds to a probability of approximately 0.972, which means that 97.2% of the time, 45 samples from a normal population will have a greater proportion than 0.55 falling within one standard deviation (the offset threshold). The result is therefore statistically significant and, hence, the hypothesis that the readings came from a normal distribution with standard deviation, σ, is rejected. If the number of samples were increased to, say, 200, then for the same proportion, θ, z would equal −4.039, which corresponds to a probability of about 0.999973, meaning that about 99.9973% of the time, the proportion of 200 readings within the offset threshold would be greater than 0.55 for a normal distribution with standard deviation, θ. Again, the hypothesis that the readings came from a normal distribution with standard deviation, θ, is rejected.

The value of z from Equation 10, which is an indirect measure of statistical significance, expresses the tolerance for error in making a decision about the accuracy of σ as the standard deviation of the DGPS system. If that tolerance is based on a significance level of 5%, then the corresponding z values would lie between ±1.65 (positive for a proportion, θ, above σ, and negative for a proportion, θ, below σ). Rearranging Equation 10 for θ as a function of z and N (Equation 11), for N=45, the proportion of readings, θ, that fall within the offset threshold would lie between 0.568 and 0.797 for the hypothesis that the sample is from a normal distribution with standard deviation, σ, to be accepted.

$$\theta = \theta + z\sqrt{\frac{\theta_o(1-\theta_o)}{N}} \quad \text{(Eq. 11)}$$

Thus, using Equation 11, the accuracy of using the particular offset threshold can be immediately determined. This enables the system 90 to choose between several candidate estimates for UERE (DGPS σ) by comparing the proportion of readings that fall within the offset threshold for each UERE value and selecting the one that is closest to 0.6829 (i.e., assuming that one standard deviation is the offset threshold). An underlying assumption here is that the limited sample size is large enough to be representative of the population (i.e., of a normal distribution).

EXAMPLE 3

The DGPS error propagation routine 50 can employ a routine to verify DGPS veracity. In addition to selecting a suitable UERE value (e.g., Example 2, above), the system 90 preferably determines whether the DGPS unit 100 (FIG. 9) is accurately reporting differential lock and HDOP. The method is similar to Example 2, except that each sample offset is compared to the particular UERE implied by the differential lock and HDOP reported with that sample, instead of a presupposed UERE (the URE value is known, and is constant). Thus, the proportion computed is a measure of whether the DGPS unit 100 is accurately reporting differential lock and HDOP. If the value for z lies within the acceptable range of z values, which depends on the chosen level for statistical significance (e.g., 5%), then the hypothesis that the DGPS unit 100 can be believed is accepted.

EXAMPLE 4

The initial location of the train is determined at system restart. One example method for doing this involves first determining whether the DGPS unit 100 (FIG. 9) is functioning properly using the proportion test of Example 3, above. The system 90 (FIG. 9) will then determine which track segment is closest to the train (e.g., locomotive). If there is only one possible track segment at that point, then that track segment is declared to be the initial location. Otherwise, if there are parallel track segments, then the system 90 must select the best candidate. The method for selecting among parallel track segments is to conduct a test of the proportion, assuming the train is on each candidate track segment in succession. After enough samples have been collected, such that at least one of the proportion test results falls within the acceptable range of z values, the track segment associated with the z value closest to zero is declared to be the initial location. Preferably, the selected initial location (or selected initial location pair) is presented to a suitable person for manual confirmation and/or selection.

EXAMPLE 5

Figure 6:
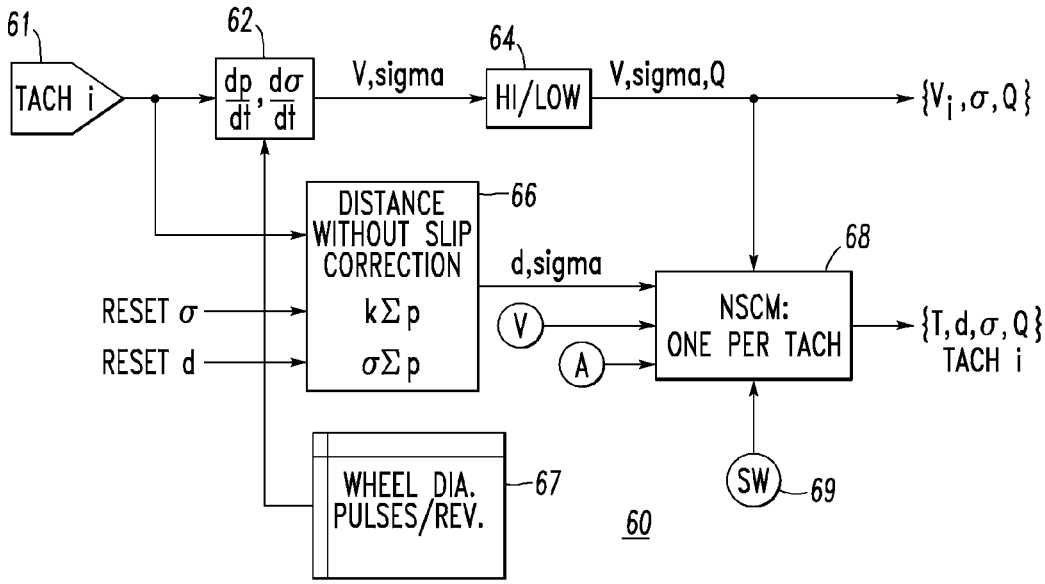
FIG. 6 is a block diagram of a tachometer error propagation routine in accordance with an embodiment of the invention.

FIG. 6 shows a tachometer error propagation routine 60, which corresponds to one of the two tachometers 102,104 of FIG. 9. In this example, the uncorrected tachometer bias is presumed to be on the order of about ¾" per revolution. The wheel wear indicator input, at 67, indicates wheel size (diameter), which is rounded up to the nearest unit (typically ⅛"). The wheel diameter is on the order of about 40". Tachometers typically produce between about 40 and 800 pulses per revolution, leading to an uncertainty (jitter) of between about 3" and 0.15" per sample, with a strong tendency to offset. Any pulse rate in excess of about 30 pulses per revolution (ppr) is acceptable for the routine 60.

At 61 of FIG. 6, the corresponding tachometer (102 or 104 of FIG. 9) is sampled to get a value, $Tach_i$, which represents the count of pulses since the previous sample. Next, at 62, the velocity, V, and sigma, σ, for the corresponding tachometer are determined based upon the respective derivative, dp/dt, of the count of pulses, and the derivative, dσ/dt, of sigma. Next, a Hi/Low filter 64 detects a slip condition (e.g., wheels spinning due to power being applied to move the train) or a slide condition (e.g., wheels locking due to brakes being applied to stop the train). This filter 64 outputs a limited velocity, V, and the same sigma, σ, along with a quality, Q (e.g., Q=1 for no slip/slide condition; Q=0, otherwise).

At 66, a Distance function 66 determines the distance, d, and sigma from Equations 12 and 13, respectively.

$$d = k\Sigma p \quad \text{(Eq. 12)}$$

$$\sigma_o = \sigma_i \Sigma_p \quad \text{(Eq. 13)}$$

wherein:

k in Equation 12 is the predetermined distance per pulse for the tachometer;

p in Equations 12 and 13 is the count of pulses; and $\sigma_i$ is the tachometer σ, which is a function of the wheel diameter and the tachometer gear tooth count (i.e., pulses per revolution). The calculated values of d and sigma are reset under good conditions by signals RESET d 88 and RESET σ86, respectively, from FIG. 8. Each of the signals, RESET d and RESET σ, includes a Boolean flag (to signify a reset condition) and a value (to signify the reset value) for the calculated values of d and sigma, respectively.

Figure 7:
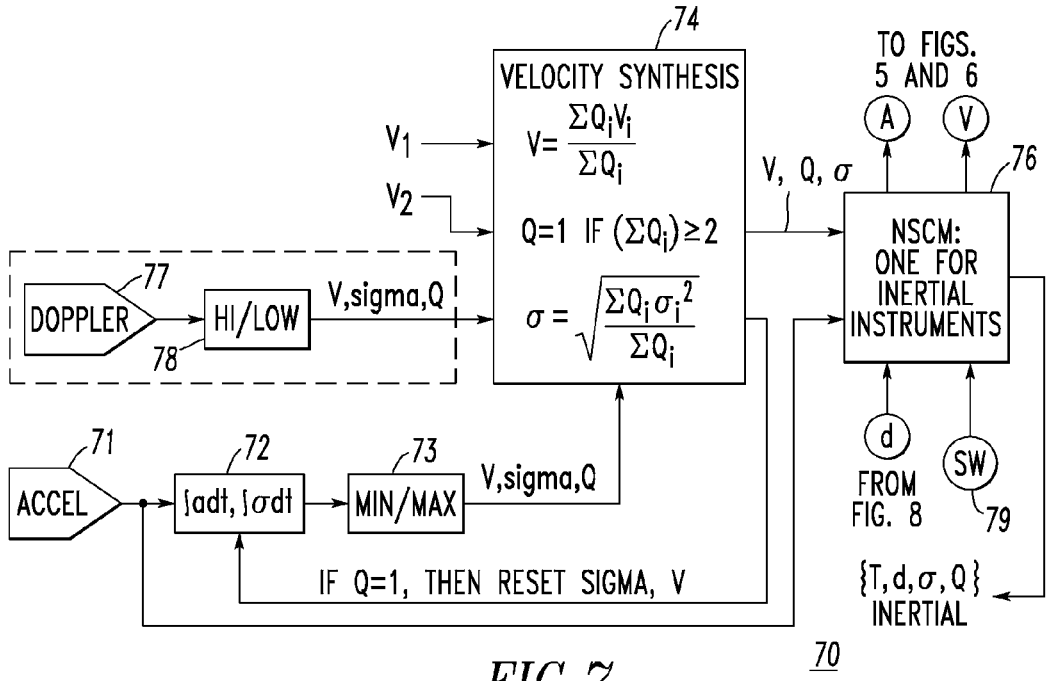
FIG. 7 is a block diagram of an inertial instruments error propagation routine in accordance with an embodiment of the invention.

Next, the NSCM function 68 selects the tachometer integrated distance from 66, unless the Hi/Low filter 64 detects slip/slide, in which case the distance is updated based on the best acceleration and velocity produced from the inertial instruments, at function 76 of FIG. 7. In that event, the position from the NSCM function 68 is output as a (T,d) pair along with position quality, Q (e.g., Q=0 for a previously unknown position; Q=1 for a previously known position), and sigma. In the vicinity of a railroad switch, the SW function 69 determines on which track segment the train is positioned (i.e., the system uses railroad switch position (normal, reverse) information in conjunction with the track map (which also contains railroad switch locations and track segment connections) and the last known location of the train to determine which track segment the train has moved onto as the train is seen to move). Based upon this, the (T,d) pair is suitably adjusted.

EXAMPLE 6

FIG. 7 shows an inertial instruments error propagation routine 70, which is associated with the accelerometer 106 of FIG. 9. For example, practical, commercially available, accelerometer sensitivity is currently about 0.01 ft/sec$^2$ or less. Sensitivities of about 0.1 ft/sec$^2$ or better are acceptable to the routine 70.

At 71, the accelerometer 106 of FIG. 9 is read. Next, at 72, the velocity, V, and sigma values are generally determined from Equations 14 and 15:

$$V=\int a dt \quad \text{(Eq. 14)}$$

$$\sigma=\int \sigma_a dt \quad \text{(Eq. 15)}$$

wherein: $\sigma_a$ is the accelerometer uncertainty.

However, if the velocity synthesis quality does not depend on the accelerometer input (e.g., the quality, Q, from the Velocity Synthesis function 74 is otherwise good from the tachometers 102,104 of FIG. 9 or from the optional Doppler radar input 77), then the accelerometer derived velocity and associated uncertainty from functions 73,74 are reset to the synthetic velocity and uncertainty from the Velocity Synthesis function 74. Next, at 73, the accelerometer derived velocity is limited to reasonable minimum and maximum values, wherein the term "reasonable" is defined by the physical characteristics of the locomotive system. In the Velocity Synthesis function 74, the velocity, V, is determined (as in Equation 1) from the average of the various input velocity values which have good quality (i.e., Q=1). Here, the various input velocity values may include, for example, two or more tachometer velocities (e.g., $V_1$,$V_2$), the accelerometer velocity from minimum/maximum function 73 and/or the optional velocity from the Doppler radar input 77 as limited to reasonable minimum and maximum values by hi/low limiter 78. Each of these inputs includes velocity, quality and sigma values (V,Q,σ). The GPS-derived Doppler velocity from input 77 is checked by function 78 for unreasonable velocity changes in the same manner as for tachometer readings. The quality, Q, as output by the Velocity Synthesis function 74, is good if two or more of the various input velocity values have good quality. The sigma, σ, is determined (as in Equation 1) from the various input sigma values which have good quality (i.e., Q=1). Here, for example, the velocity quality can be good even with no working tachometers 102,104 (FIG. 9), provided that the GPS-derived Doppler velocity and accelerometer derived velocities both have good quality.

The NSCM function 76 (e.g., Equations 3-5 and/or 6) takes the synthesized position, d (as will be discussed below in connection with output 84 of FIG. 8), along with the previous Velocity Synthesis report (V,Q,σ) and the output 71 of the accelerometer 106 as input, and outputs the synthesized velocity, V, and synthesized acceleration, A, for FIGS. 5 and 6. The SW function 79 determines on which track segment the train is positioned, as discussed above. The position uncertainty, σ, output from function 76 is updated by applying Equation 6 to the input σ values from signal d, the velocity signal from function 74 and the accelerometer signal from input 71. The Q output from function 76 is simply copied from the Q portion of the signal from function 74. Based upon this, the output (T,d) pair is suitably updated.

Figure 8:
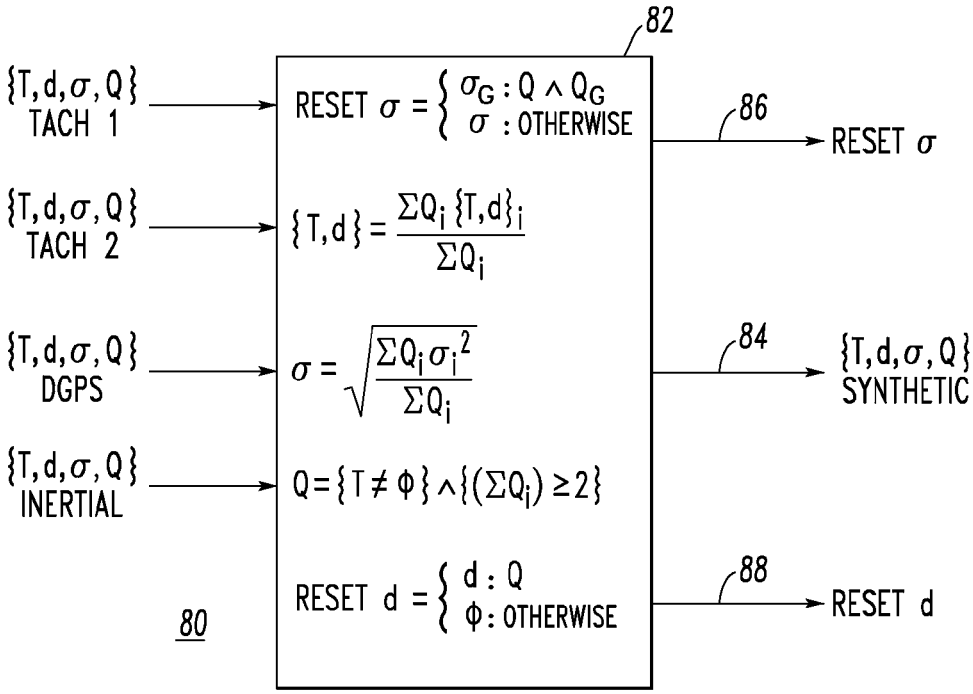
FIG. 8 is a block diagram of a Vital Position Synthesis function in accordance with an embodiment of the invention.
Figure 9:
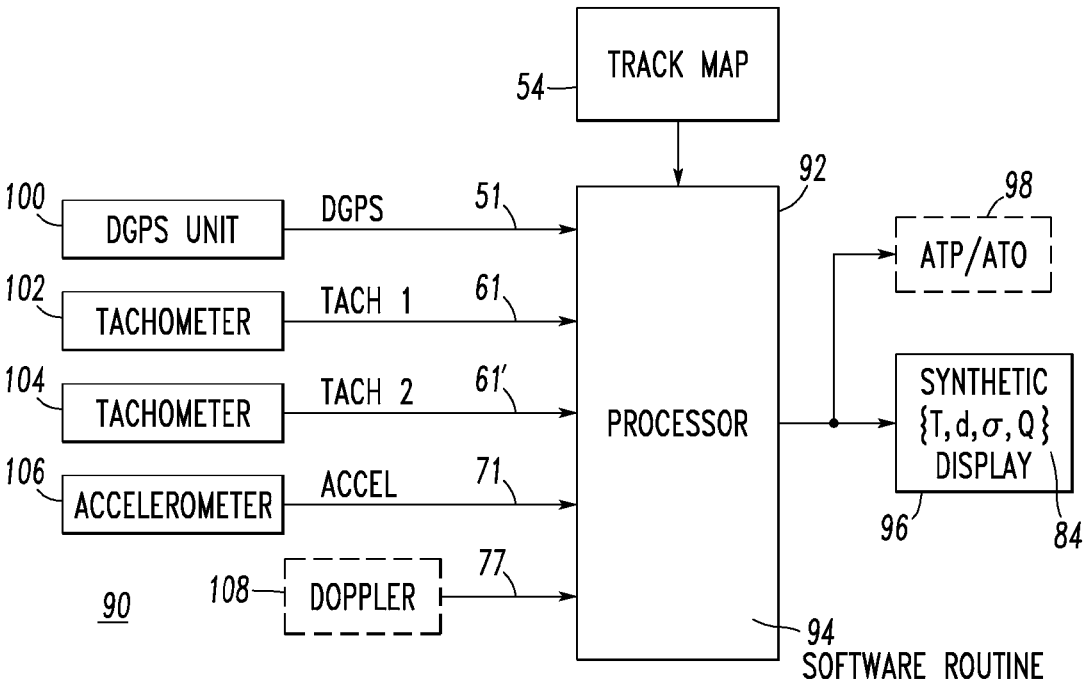
FIG. 9 is a block diagram of a position system for vitally determining the position of a railroad vehicle in accordance with an embodiment of the invention.

FIG. 8 shows a Vital Position Synthesis function 80, which inputs reports of position, sigma and quality (T,d,σ,Q) from the DPGS unit 100 (FIG. 9), tachometers 102,104 (FIG. 9), and the inertial instruments error propagation routine 70 (FIG. 7). The function 82 includes three outputs 84,86,88. The output 84 includes the synthetic values for position, sigma and quality (T,d,σ,Q). The synthetic position (T,d) is determined (as in Equation 1) from the average of the various input position (T,d) values which have good quality (i.e., Q=1). The synthetic sigma, σ, is determined (as in Equation 1) from the various input sigma values which have good quality (i.e., Q=1). The synthetic quality, Q, is bad if either the synthetic track segment position, T, is null, or if there is less than two inputs with good quality; here, the system 90 cannot guarantee the train position. Hence, to fail safely, either the train must stop, or the engineer may operate the train under restricted speed and without position system related functions. Otherwise, the synthetic quality, Q, is good if both the synthetic track segment position, T, is not null, and if there are at least two inputs with good quality. Hence, the system 90 can guarantee that the train position is reliable.

For the output 86, if the synthetic quality, Q, is good, and if the DGPS quality, $Q_G$, is also good, then the position uncertainty, σ, is reset to the GPS uncertainty, $\sigma_G$ (i.e., RESET σ includes a Boolean value, which is true, and the GPS uncertainty, $\sigma_G$). Otherwise, RESET σ includes a Boolean value, which is false, and the position uncertainty, σ, is not reset, and will tend to increase as the train moves.

For the output 88, if the synthetic quality, Q, is good, then the tachometer reference position will be reset (i.e., RESET d includes a Boolean value, which is true, and the synthetic position, d). Otherwise, RESET d includes a Boolean value, which is false, and the position, d, is a null.

The vital synthetic position uncertainty, σ, for vital braking is taken to be 4σ (as was discussed above in connection with FIG. 4). Other ATP/ATO operations may use suitably smaller uncertainty buffers.

FIG. 9 shows a position system 90 including a processor 92 having a software routine 94 (e.g., routines 50, 60, 70 and 80), a display 96, the track map 54 (FIG. 5), the DGPS input 51 (FIG. 5) from the DGPS unit 100, the first tachometer Tach1 input 61 (FIG. 6) from the tachometer 102, a second tachometer Tach2 input 61' from the tachometer 104, the Accel input 71 (FIG. 7) from the accelerometer 106, and the optional Doppler radar input 77 (FIG. 7) from the Doppler radar 108. The processor display 96 includes the synthetic output (T, d, σ, Q) 84 (FIG. 8), which may also be output to the ATP/ATO 98.

While for clarity of disclosure reference has been made herein to the example display 96 for displaying the synthetic output (T, d, σ, Q) 84, it will be appreciated that such information may be stored, printed on hard copy, be computer modified, or be combined with other data. All such processing shall be deemed to fall within the terms "display" or "displaying" as employed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A system for vitally determining position of a railroad vehicle, said system comprising:

a plurality of diverse sensors structured to repetitively sense at least change in position and acceleration of said railroad vehicle;

a global positioning system sensor, which is diverse from each of said diverse sensors, structured to repetitively sense position of said railroad vehicle;

a track map including a plurality of track segments which may be occupied by said railroad vehicle; and a processor cooperating with said diverse sensors, said global positioning system sensor and said track map, said processor comprising a routine structured to provide measurement uncertainty for each of said diverse sensors and said global positioning system sensor, to cross-check measurements for each of said diverse sensors, to cross-check said global positioning system sensor against said track map, and to provide the vitally determined position of said railroad vehicle and the uncertainty of said vitally determined position, wherein said cross-check for each of said diverse sensors includes a cross-check against an independent measurement of another one of said diverse sensors or a cross-check against an independent calculation based upon another one of said diverse sensors or said global positioning system sensor, wherein said routine is structured to determine a position, the measurement uncertainty and a quality corresponding to each of said diverse sensors, wherein said quality is one of a good quality value and a bad quality value, wherein said routine is further structured to vitally determine said position as a function of the average of the positions corresponding to the good quality value of said diverse sensors, wherein said vitally determined position includes a track segment and a position along said track segment, and wherein said routine is further structured to determine a good quality value corresponding to said vitally determined position when said track segment is not null and when a plurality of said diverse sensors have said good quality value.

2. The system of claim 1 wherein the vitally determined position of said railroad vehicle is structured to be used by an automatic train protection function or an automatic train operation function.

3. The system of claim 1 wherein said processor includes a display structured to display the vitally determined position of said railroad vehicle.

4. The system of claim 1 wherein the uncertainty of said vitally-determined position corresponds to the probability of a hazardous event resulting from a failure of said system being less than about $10^{-9}$/hour.

5. The system of claim 1 wherein said global positioning system sensor includes a position coordinate and a position uncertainty value; and wherein said routine is structured to cross-check said global positioning system sensor against said track map by projecting the position coordinate onto one of the track segments of said track map along a line perpendicular to said one of said track segments and determining if the distance from said position coordinate to said one of said track segments along said line is less than a predetermined value times said position uncertainty value.

6. The system of claim 1 wherein said global positioning system sensor outputs a position; wherein said independent calculation outputs a vitally determined velocity and a vitally determined acceleration; wherein said routine includes a navigational state change calculation inputting the position from said global positioning system sensor, said vitally determined velocity and said vitally determined acceleration, and outputting a position; and wherein one of said cross-checks is a cross-check of the position of said global positioning system sensor against the position of said navigational state change calculation.

7. The system of claim 6 wherein said cross-check of said global positioning system sensor against said navigational state change calculation provides the good quality value corresponding to the position of said global positioning system sensor when the position of said global positioning system sensor is consistent with the position output by said navigational state change calculation for at least three consecutive samples of the position of said global positioning system sensor.

8. The system of claim 1 wherein one of said diverse sensors is a tachometer including an output having a position; wherein said independent calculation outputs a vitally determined velocity and a vitally determined acceleration; wherein said routine includes a navigational state change calculation inputting the position from said tachometer, said vitally determined velocity and said vitally determined acceleration, and outputting a position; and wherein one of said cross-checks is a cross-check of the position of the output of said tachometer against and the position output by said navigational state change calculation.

9. The system of claim 8 wherein said cross-check of said tachometer against said navigational state change calculation provides the good quality value when the position indicated by the output of said tachometer is consistent with the position output by said navigational state change calculation.

10. The system of claim 1 wherein two of said diverse sensors are tachometers each of which includes an output having a position; wherein one of said diverse sensors is an accelerometer including an acceleration; wherein said routine is structured to determine a velocity corresponding to the position of the output of each of said tachometers, and a velocity corresponding to the acceleration of said accelerometer; and wherein one of said cross-checks is a cross-check of the velocity corresponding to the position of the output of each of said tachometers against the velocity corresponding to the acceleration of said accelerometer.

11. The system of claim 10 wherein said routine is further structured to determine one of the good quality value and the bad quality value corresponding to the velocity corresponding to the position of the output of each of said tachometers and the velocity corresponding to the acceleration of said accelerometer, and an average velocity as a function of the average of the velocities corresponding to the good quality value for a plurality of: (a) said tachometers, and (b) said accelerometer.

12. The system of claim 11 wherein said diverse sensors are further structured to repetitively sense velocity of said railroad vehicle; wherein said diverse sensors include a Doppler radar having a velocity; and wherein one of said cross-checks is a cross-check of the velocity corresponding to the position of the output of each of said tachometers against the velocity of said Doppler radar.

13. The system of claim 11 wherein said routine is further structured to determine a standard deviation corresponding to the velocity for each of said tachometers, a standard deviation corresponding to the velocity corresponding to the acceleration of said accelerometer, and a standard deviation corresponding to said average velocity.

14. The system of claim 1 wherein said diverse sensors include a plurality of tachometers and an inertial sensor; wherein said routine is structured to determine the position, the measurement uncertainty and the quality corresponding to each of said tachometers, said inertial sensor and said global positioning system sensor; and wherein said routine is further structured to vitally determine said position as a function of the average of the positions corresponding to the good quality value of said tachometers, said inertial sensor and said global positioning system sensor.

15. The system of claim 14 wherein said routine is further structured to determine the uncertainty of said vitally determined position as a function of the measurement uncertainties corresponding to the good quality value of said tachometers, said inertial sensor and said global positioning system sensor.

16. A system for vitally determining position of a railroad vehicle, said system comprising:

a plurality of diverse sensors structured to repetitively sense at least change in position and acceleration of said railroad vehicle;

a global positioning system sensor, which is diverse from each of said diverse sensors, structured to repetitively sense position of said railroad vehicle;

a track map including a plurality of track segments which may be occupied by said railroad vehicle; and a processor cooperating with said diverse sensors, said global positioning system sensor and said track map, said processor comprising a routine structured to provide measurement uncertainty for each of said diverse sensors and said global positioning system sensor, to cross-check measurements for each of said diverse sensors, to cross-check said global positioning system sensor against said track map, and to provide the vitally determined position of said railroad vehicle and the uncertainty of said vitally determined position;

wherein said cross-check for each of said diverse sensors includes a cross-check against an independent measurement of another one of said diverse sensors or a cross-check against an independent calculation based upon another one of said diverse sensors or said global positioning system sensor;

wherein said diverse sensors include a plurality of tachometers and an inertial sensor; wherein said routine is structured to determine a position, the measurement uncertainty and a quality corresponding to each of said tachometers, said inertial sensor and said global positioning system sensor; wherein said quality is one of a good quality value and a bad quality value; and wherein said routine is further structured to vitally determine said position as a function of the average of the positions corresponding to the good quality value of said tachometers, said inertial sensor and said global positioning system sensor;

wherein said vitally determined position includes a track segment and a position along said track segment; and wherein said routine is further structured to determine a good quality value corresponding to said vitally determined position when said track segment is not null and when a plurality of said tachometers, said inertial sensor and said global positioning system sensor have said good quality value.

17. The system of claim 14 wherein said routine is further structured to reset the position corresponding to each of said tachometers to said vitally determined position when there is said good quality value corresponding to said vitally determined position, and, otherwise, to not reset the position corresponding to each of said tachometers.

18. A system for vitally determining position of a railroad vehicle, said system comprising:

a plurality of diverse sensors structured to repetitively sense at least change in position and acceleration of said railroad vehicle;

a global positioning system sensor, which is diverse from each of said diverse sensors, structured to repetitively sense position of said railroad vehicle;

a track map including a plurality of track segments which may be occupied by said railroad vehicle; and a processor cooperating with said diverse sensors, said global positioning system sensor and said track map, said processor comprising a routine structured to provide measurement uncertainty for each of said diverse sensors and said global positioning system sensor, to cross-check measurements for each of said diverse sensors, to cross-check said global positioning system sensor against said track map, and to provide the vitally determined position of said railroad vehicle and the uncertainty of said vitally determined position;

wherein said cross-check for each of said diverse sensors includes a cross-check against an independent measurement of another one of said diverse sensors or a cross-check against an independent calculation based upon another one of said diverse sensors or said global positioning system sensor;

wherein said diverse sensors include a plurality of tachometers and an inertial sensor; wherein said routine is structured to determine a position, the measurement uncertainty and a quality corresponding to each of said tachometers, said inertial sensor and said global positioning system sensor; wherein said quality is one of a good quality value and a bad quality value; and wherein said routine is further structured to vitally determine said position as a function of the average of the positions corresponding to the good quality value of said tachometers, said inertial sensor and said global positioning system sensor;

wherein said routine is structured to determine a position, the measurement uncertainty and a sensor quality corresponding to each of said diverse sensors and said global positioning system sensor; wherein the vitally determined position of said railroad vehicle corresponds to a position quality; wherein each of said sensor quality and said position quality is one of a good quality value and a bad quality value; and wherein said routine is further structured to reset the uncertainty of said vitally determined position to the measurement uncertainty corresponding to said global positioning system sensor if both of said position quality and the quality of said global positioning system sensor have the good quality value, and, otherwise, to increase the uncertainty of said vitally determined position with movement of said railroad vehicle.

19. The system of claim 1 wherein said diverse sensors are further structured to repetitively sense velocity of said railroad vehicle; and wherein said diverse sensors comprise at least three of: two tachometers structured to measure position, a Doppler radar structured to measure velocity, and an accelerometer structured to measure acceleration.

20. The system of claim 1 wherein said vitally determined position of said railroad vehicle is structured to be used in a guide-way position system without sensors attached to said guide-way.

21. The system of claim 1 wherein said global positioning system sensor is the only direct measurement of location in the system.

22. A method of vitally determining a position of a railroad vehicle, said method comprising:

employing a plurality of diverse sensors to repetitively sense at least change in position and acceleration of said railroad vehicle;

employing a global positioning system sensor, which is diverse from each of said diverse sensors, to repetitively sense position of said railroad vehicle;

employing a track map including a plurality of track segments which may be occupied by said railroad vehicle;

providing measurement uncertainty for each of said diverse sensors and said global positioning system sensor;

cross-checking measurements for each of said diverse sensors;

cross-checking said global positioning system sensor against said track map;

providing the vitally determined position of said railroad vehicle and the uncertainty of said vitally determined position from the sensed at least change in position and acceleration of said railroad vehicle from said diverse sensors and from the sensed position of said railroad vehicle from said global positioning system sensor;

employing said cross-check for each of said diverse sensors including a cross-check against an independent measurement of another one of said diverse sensors or a cross-check against an independent calculation based upon another one of said diverse sensors or said global positioning system sensor;

determining a position, the measurement uncertainty and a quality corresponding to each of said diverse sensors;

employing said quality as one of a good quality value and a bad quality value;

vitally determining said position as a function of the average of the positions corresponding to the good quality value of said diverse sensors;

employing said vitally determined position including a track segment and a position along said track segment; and determining a good quality value corresponding to said vitally determined position when said track segment is not null and when a plurality of said diverse sensors have said good quality value.

* * * * *

UNITED STATES PATENT AND TRADEMARK OFFICE

CERTIFICATE OF CORRECTION

PATENT NO. : 8,296,065 B2
APPLICATION NO. : 12/480354
DATED : October 23, 2012
INVENTOR(S) : Michael B. Haynie et al.

It is certified that error appears in the above-identified patent and that said Letters Patent is hereby corrected as shown below:

Title page, second column, OTHER PUBLICATIONS, "Wikimedia Foundation Inc.,"
should read --Wikimedia Foundation Inc., Wikipedia,--.
Column 8, line 39, "standard" should read --*standard*--.
Column 11, lines 12-13, "$3.4\times10^{-}{}_{24}$/hour" should read --$3.4\times10^{-24}$/hour--.
Column 11, line 41, "changes" should read --*changes*--.
Column 14, lines 38-39, $$F(x) = \int_{-\infty}^{x} \frac{1}{(\sqrt{2\pi})\sigma} e^{-(x-x)^2/2\sigma^2} dx$$

" (Eq. 9)", should read $$F(x) = \int_{-\infty}^{x} \frac{1}{(\sqrt{2\pi})\sigma} e^{-(x-\bar{x})^2/2\sigma^2} dx$$

-- (Eq. 9)--.

Column 17, line 1, "revolution). The calculated values of d and sigma are reset" should read
--revolution).
The calculated values of d and sigma are reset--.

Signed and Sealed this
Nineteenth Day of February, 2013

Teresa Stanek Rea
*Acting Director of the United States Patent and Trademark Office*